US010155150B2

(12) United States Patent
Jones

(10) Patent No.: US 10,155,150 B2
(45) Date of Patent: Dec. 18, 2018

(54) MULTI-TIER CARD SHUFFLER

(71) Applicant: Mark Hamilton Jones and Sheryle Lynn Jones Family Trust dated November 7, 2013, Gardnerville, NV (US)

(72) Inventor: Mark H. Jones, Gardnerville, NV (US)

(73) Assignee: Mark Hamilton Jones and Sheryle Lynn Jones, Gardnerville, NV (US), Family Trust dated November 7, 2013

( * ) Notice: Subject to any disclaimer, the term of this patent is extended or adjusted under 35 U.S.C. 154(b) by 0 days.

(21) Appl. No.: 13/741,012

(22) Filed: Jan. 14, 2013

(65) Prior Publication Data

US 2013/0181401 A1 Jul. 18, 2013

Related U.S. Application Data

(60) Provisional application No. 61/586,152, filed on Jan. 13, 2012.

(51) Int. Cl.

| | |
|---|---|
| ***G07F 17/34*** | (2006.01) |
| ***A63F 1/06*** | (2006.01) |
| ***A63F 1/04*** | (2006.01) |
| ***A63F 5/00*** | (2006.01) |
| ***A63F 5/04*** | (2006.01) |
| *A63F 1/12* | (2006.01) |

(52) U.S. Cl.

CPC ..... *A63F 1/06* (2013.01); *A63F 1/04* (2013.01); *A63F 5/0094* (2013.01); *A63F 5/046* (2013.01); *A63F 1/12* (2013.01)

(58) Field of Classification Search

CPC ..... G07F 17/34; G07F 17/3211

USPC ..... 273/138.1

See application file for complete search history.

(56) References Cited

U.S. PATENT DOCUMENTS

| | | | | | |
|---|---|---|---|---|---|
| 2,661,215 | A | * | 12/1953 | Stevens | A63F 1/12 270/58.01 |
| 3,232,622 | A | * | 2/1966 | Lambert | A63F 1/06 273/141 A |
| 3,588,116 | A | * | 6/1971 | Kosaburo | A63F 1/12 273/149 R |
| 3,841,637 | A | * | 10/1974 | Piazza et al. | 273/141 A |
| 4,239,226 | A | * | 12/1980 | Palmer | 273/146 |
| 4,309,035 | A | * | 1/1982 | Goldfarb | 273/237 |
| 4,448,419 | A | * | 5/1984 | Telnaes | 463/21 |
| 4,586,712 | A | * | 5/1986 | Lorber et al. | 273/149 R |
| 4,659,082 | A | * | 4/1987 | Greenberg | 273/149 R |
| 4,732,386 | A | * | 3/1988 | Rayfiel | A63F 3/0625 273/142 H |
| 5,033,751 | A | * | 7/1991 | Ching | A63F 3/00214 273/241 |
| 5,382,023 | A | * | 1/1995 | Roberts et al. | 273/142 H |

(Continued)

*Primary Examiner* — John E Simms, Jr.
*Assistant Examiner* — Dolores Collins
(74) *Attorney, Agent, or Firm* — John S. Artz; Dickinson Wright PLLC

(57) ABSTRACT

A random number generator for a game of chance includes a plurality of rotating structures. Each of the plurality of rotating structures includes a plurality of slots uniformly spaced about a center axis thereof. The random number generator includes a set of cards that are equal in number to the total number of slots such that one card is disposed in each of the slots. The generator also includes at least one detent mechanism for identifying a single card on at least one of the plurality of rotating structures.

13 Claims, 7 Drawing Sheets

(56) References Cited

U.S. PATENT DOCUMENTS

| | | | | |
|---|---|---|---|---|
| 5,820,127 | A * | 10/1998 | Rodriguez | 273/280 |
| 6,019,374 | A * | 2/2000 | Breeding | 273/292 |
| 6,299,534 | B1 * | 10/2001 | Breeding | A63F 3/081 273/274 |
| 6,536,766 | B1 * | 3/2003 | Deitch | A63F 3/00088 273/142 R |
| 6,561,512 | B2 * | 5/2003 | Luciano | A63F 5/00 273/138.2 |
| 7,464,932 | B2 * | 12/2008 | Darling | 273/144 A |
| 7,472,906 | B2 * | 1/2009 | Shai | 273/149 R |
| 7,669,853 | B2 * | 3/2010 | Jones | A63F 1/12 273/142 JA |
| 7,677,571 | B2 * | 3/2010 | Adams, III | 273/274 |
| 7,762,882 | B2 * | 7/2010 | Okada | 463/16 |
| 7,901,280 | B2 * | 3/2011 | Jarvis et al. | 463/17 |
| 7,946,586 | B2 * | 5/2011 | Krenn et al. | 273/149 R |
| 7,976,023 | B1 * | 7/2011 | Hessing et al. | 273/149 R |
| 8,317,603 | B2 * | 11/2012 | Anderson | 463/25 |
| 8,444,147 | B2 * | 5/2013 | Grauzer et al. | 273/149 R |
| 8,448,945 | B2 * | 5/2013 | Hancock | 273/142 R |
| 8,505,919 | B2 * | 8/2013 | Jones | 273/292 |
| 8,506,391 | B2 * | 8/2013 | Jaffe et al. | 463/27 |
| 8,628,086 | B2 * | 1/2014 | Krenn et al. | 273/149 R |
| 2008/0073842 | A1 * | 3/2008 | Jones | 273/149 R |
| 2012/0056373 | A1 * | 3/2012 | Jones | 273/149 R |
| 2013/0137501 | A1 * | 5/2013 | Jones | A61K 9/12 463/20 |
| 2013/0181401 | A1 * | 7/2013 | Jones | A63F 1/06 273/138.1 |
| 2013/0307216 | A1 * | 11/2013 | Jones | 273/149 R |

* cited by examiner

MULTI-TIER CARD SHUFFLER

CROSS-REFERENCE TO RELATED APPLICATIONS

The present application claims priority to U.S. Provisional Patent Application Ser. No. 61/586,152, entitled "Multi-Tier Card Shuffler", and filed on Jan. 13, 2012, which disclosure is hereby incorporated by reference as though set forth fully herein.

TECHNICAL FIELD

The present invention relates generally to a machine for identifying one or more cards from among a set of cards in a game of chance. More particularly, the present invention relates to a machine for identifying one or more cards from among a set of cards in a game of chance, including a plurality of wheels selectively rotatable about a common central axis and that can each be randomly stopped for identifying one playing card from at least one of the plurality of wheels.

BACKGROUND OF THE INVENTION

Games of chance are well known activities whose outcomes are strongly influenced by randomizing devices and upon which contestants may wager money as they forecast outcomes. Common randomizing devices include dice, spinning tops, playing cards, roulette wheels, prize wheels, and numbered balls drawn from containers. Games of chance have been played throughout all of human history and are considered to be a popular pastime by many. Players of games of chance are attracted to new and exciting methods of game play as well as new and exciting randomizing devices. For this reason, the gaming industry is continuously developing new games and new randomizing devices to maintain player interest and attract new players.

Games of chance that include money wagers are typically regulated by governing authorities. These governing authorities enforce laws and regulations that are enacted to curtail certain kinds of games as well as certain kinds of randomizing devices. For example, in some jurisdictions, the use of dice or roulette wheels to resolve a game outcome, i.e., as the randomizing device, have been curtailed while other randomizing devices such as playing cards are permitted. More frequently, randomizing devices that use playing cards have been utilized as they enjoy fewer restrictions in games of chance played for money than dice and roulette wheel randomizing devices.

Additionally, table games managers are continually looking for ways to improve the efficiency of their Dealers in connection with all games, thereby reducing labor costs in the long run. Unlike slot managers, who do not have to worry about employee mistakes that cost the casino money (known as bleed), table games managers face these issues on a daily basis. As casinos gets busier and the tables get fuller, the decisions per hour can decrease dramatically and the potential for bleed increases significantly.

Therefore, there is a desire within the gaming industry to develop new and interesting methods of game play and randomizing devices which utilize playing cards in unique and interesting ways, suited to fast-paced, high-volume activity and which minimize the opportunity for bleed.

SUMMARY OF THE INVENTION

It is therefore an advantage of the present disclosure to provide a table game system that can improve the efficiency of the casino Dealers.

It is another advantage of the present disclosure to provide a table game system that can reduce the labor costs attributable to the operation of the game.

It is still another advantage of the present disclosure to provide a table game system that can minimize Dealer errors and bleed.

It is a further advantage of the present disclosure to provide a table game system that can provide increased player entertainment and enjoyment.

In accordance with the above and the other advantages of the present disclosure, an improved table game system is provided. The table game system includes a shuffler machine for randomly selecting a first card from among a first set of cards. The shuffler machine includes a plurality of rotating structures each of which has a plurality of slots uniformly spaced apart from one another about an axis of rotation of each of the plurality of rotating discs. The first set of cards in aggregate equals the number of slots that exist in the plurality of rotating structures. One card of the first set of cards is disposed in each of the plurality of slots. The shuffling machine also includes at least one detent mechanism for randomly identifying a single card on at least one of the plurality of rotating structures.

According to another aspect, a method of playing a game of chance is provided. According to an aspect of the method, a plurality of rotating structures are provided. A single card from a set of cards is placed in each of a plurality of slots formed in the plurality of rotating structures such that the total number of cards in the set of cards equals the total number of slots formed in the rotating structures. Each of the plurality of rotating structures are spun. At least one detent mechanism is selectively engaged to cause at least one of the plurality of rotating structures to slow and stop. At least one card is randomly identified that is relevant to the outcome of the game of chance.

BRIEF DESCRIPTION OF THE DRAWINGS

These and other features and advantages of the present invention will become more readily appreciated when considered in connection with the following detailed description and appended drawings wherein.

DETAILED DESCRIPTION OF THE PREFERRED EMBODIMENT

The present disclosure relates to a table game system 10 including a random number generator that allows one or more cards to be randomly drawn at a single time. According to an aspect, the disclosed random number generator allows multiple games to be played simultaneously, which allows for more game outcomes over the same period of time than prior random number generators. Alternatively, the disclosed random number generator may allow a single game to be played that utilizes two numbers to determine the outcome in a shorter time period than with prior random number generators. Still further, the disclosed random number generator allows a single game to be played where one number determines the outcome of the game of chance.

Figure 1:
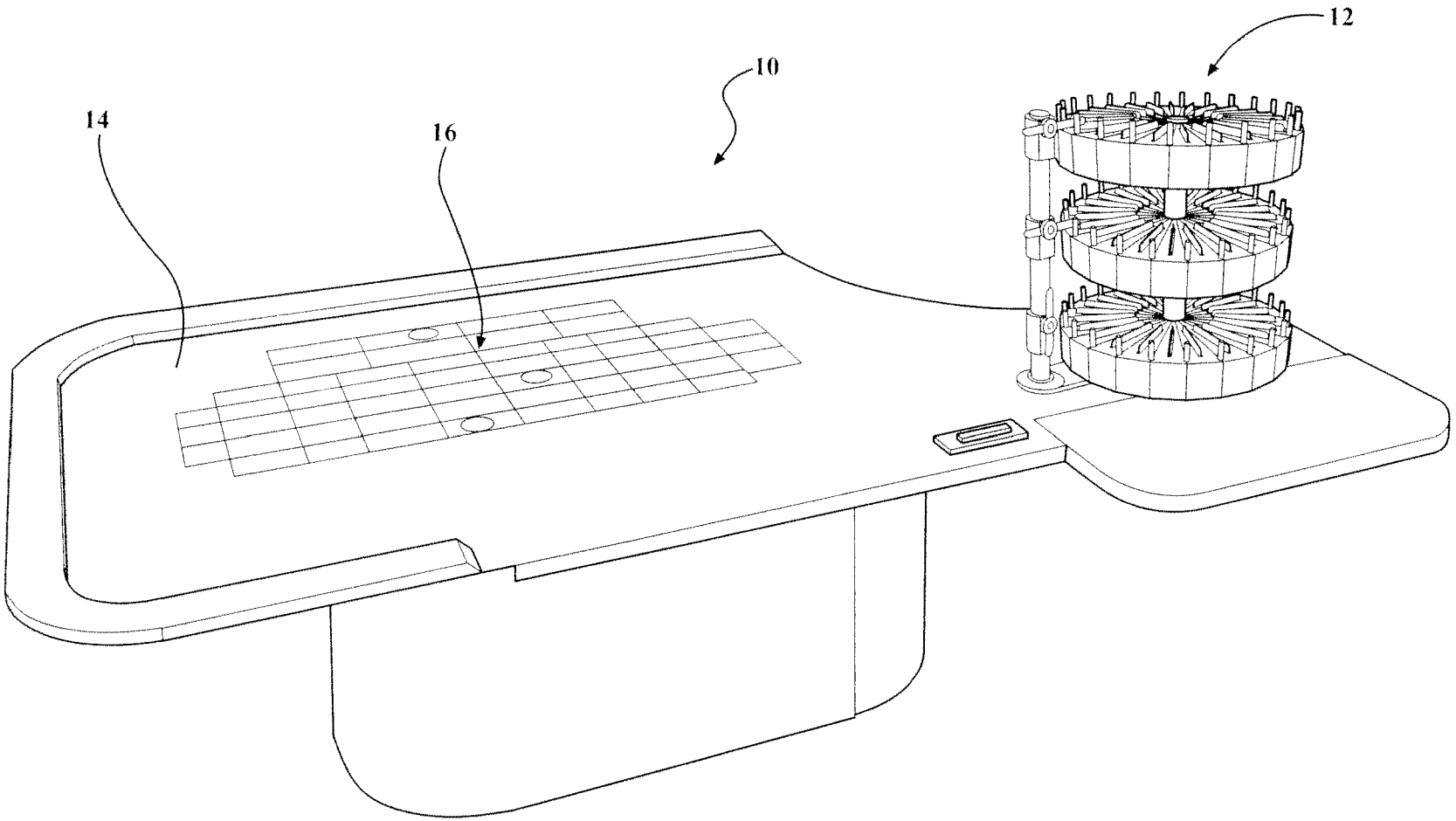
FIG. 1 is a perspective view of a table game system, including a shuffler machine, according to an aspect of the disclosure.

FIG. 1 illustrates a table game system 10, including a random number generator, according to an aspect of the disclosure. According to this aspect, the random number generator may be a card shuffler machine 12. It will be appreciated that the other random number generators may be utilized in accordance with the disclosed aspects. As shown, the card shuffler machine 12 may be disposed on a relatively flat table 14. The system 10 may include a game layout 16 disposed thereon that is relevant to the game of chance being played. For example, the game layout 16 could be configured for the game of roulette. Alternatively, the game layout 16 could be configured for the game of craps or any other casino game where the random selection of one or more numbers can decide the game outcome. According to an aspect, the card shuffler machine 12 randomly selects at least one card to determine the outcome of the game of chance. Once the card has been selected, a live Dealer could be utilized to remove the card from the shuffler machine 12, display the selected card, such as by placing it on the table 14 for display. Once the selected card has been identified, the Dealer can then settle any wagers placed on the game layout 16 based on the outcome of the game.

Alternatively, instead of a fully manual system, the Dealer could remove the card from the shuffler machine 12 and enter it into a computer that displays the selected card on one or more display screens associated with the table game system. Instead of or in addition to the game layout 16, a plurality of player terminals (not shown) could be included that allow players to input their bets and which will automatically resolve any wagers, such as is disclosed in more detail in Applicant's co-pending application Ser. No. 13/691,290 entitled "Turbo Card Table Game with RFID Card Identifier", and filed on Nov. 30, 2012, which is hereby incorporated by reference as though set forth fully herein. This can help minimize the potential for any Dealer errors.

The cards in the shuffling machine could include a readable indicia, such as a bar code or and RFID tag that allows the cards to be read by a card reader (not shown) in order to further minimize Dealer error that could result from manually inputting the card to a computer. Such a feature is also disclosed in more detail in Applicant's co-pending application Ser. No. 13/691,290. Additionally, the entire process could be automated, which would eliminate the need for a Dealer at all, such as is disclosed in Applicant's application Ser. No. 61/749,725, entitled "Automated Multi-Game Card Reading Apparatus" and filed on Jan. 7, 2012, which disclosure is hereby incorporated by reference as though set forth fully herein.

Figure 2:
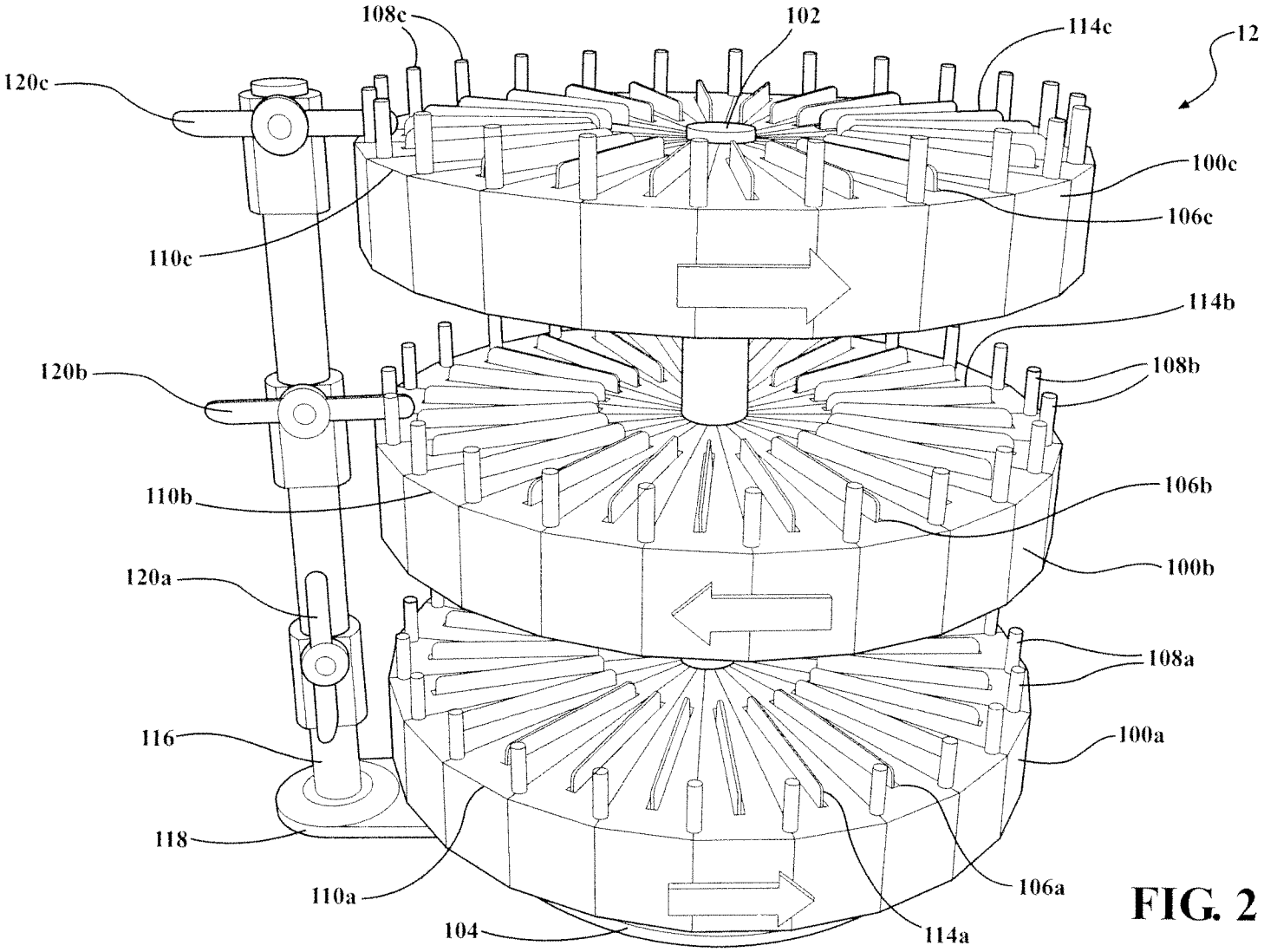
FIG. 2 is a perspective view of the shuffler machine for a table game system according to an aspect of the disclosure.
Figure 3:
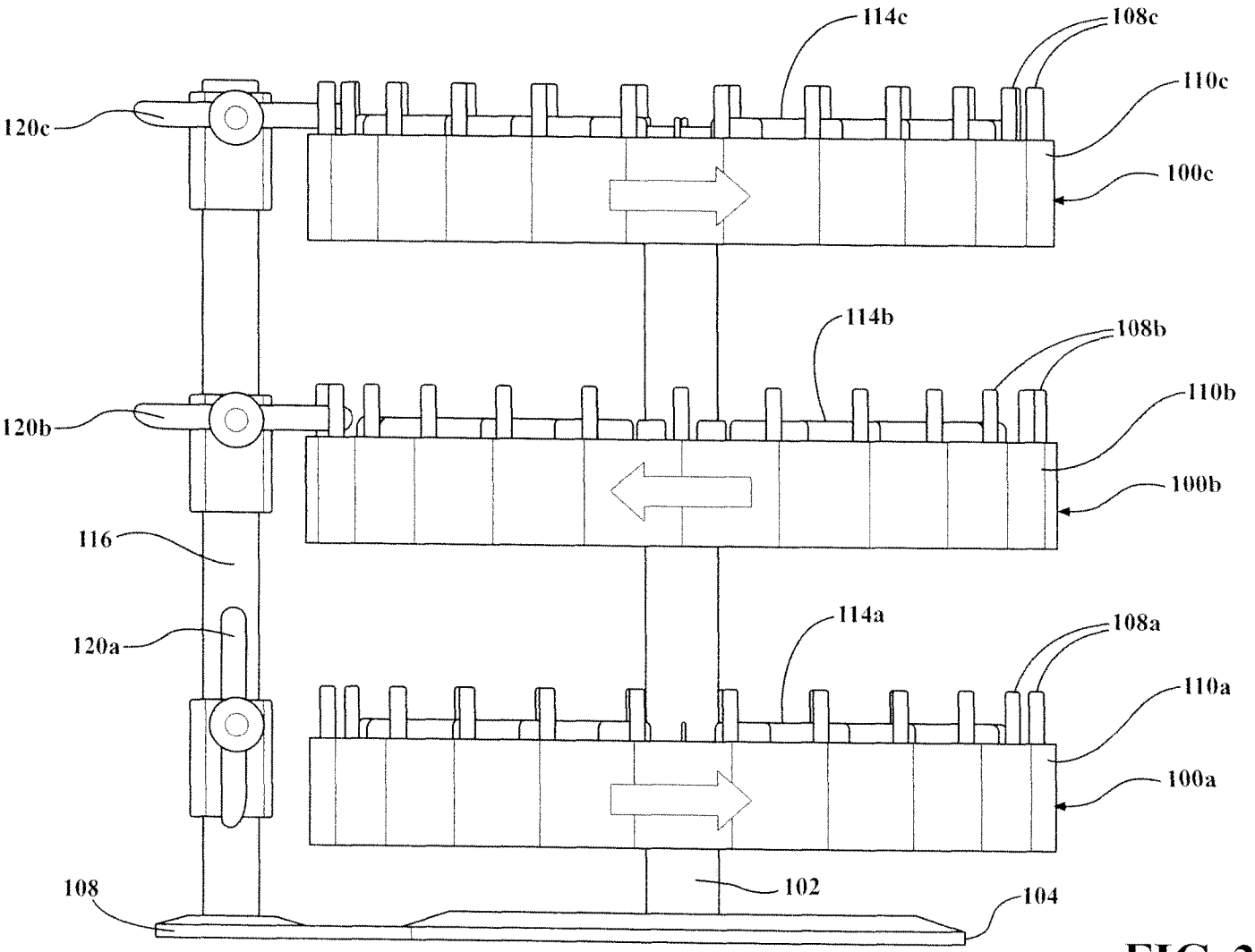
FIG. 3 is a side view of the shuffler machine of FIG. 2.

With reference to FIGS. 2 and 3, the card shuffler machine 12 can select one or more cards from among a set of cards in a game of chance. According to an aspect, the shuffler machine 12 includes three turntables 100*a*, 100*b*, 100*c*. Alternatively, the card shuffler machine 12 may have more or less than three turntables, as desired. According to another aspect, the plurality of turntables 100*a*, 100*b*, 100*c* are supported one over the other about a generally vertical common axis A by a central shaft 102 that runs through the center of the turntables 100*a*, 100*b*, 100*c*. The central shaft 102 can be secured to a base portion 104 to provide stable support for the shuffler machine 12. The base portion 104 may be configured to rest atop a gaming table 14 like that illustrated in FIG. 1. Alternatively, the base portion could be supported directly on the floor, or via other supporting member. Each turntable 100*a*, 100*b*, 100*c* is rotatably supported above the base portion 102 for free rotation (relative to the other turntables) within a generally horizontal plane about the common vertical axis A. As shown in FIGS. 2 and 3, the turntables 100*a*, 100*b*, 100*c* could be rotated in opposing directions. According to another aspect, the turntables could be arranged with respect to one another in a variety of other suitable ways.

As shown, according to an aspect, each turntable 100*a*, 100*b*, 100*c* can include a defined number of trays 106*a*, 106*b*, 106*c* formed therein. Each tray 106 is preferably equally circumferentially spaced apart from the other trays about the central axis A. Each turntable 100*a*, 100*b*, 100*c* can also include a plurality of dividers 108*a*, 108*b*, 108*c* shown here in the form of upstanding pins located at the outer periphery 110*a*, 110*b*, 110*c* of each tray. The plurality of dividers 108*a*, 108*b*, 108*c* are equal in number to the defined plurality of trays 106*a*, 106*b*, 106*c* and are spaced one from another in equal circumferentially spaced increments about the central axis A. Each tray 106*a*, 106*b*, 106*c* is configured to retain a single card 114*a*, 114*b*, 114*c* therein. According to an aspect, the depth of each tray 106*a*, 106*b*, 106*c* is less than the width of each card 114*a*, 114*b*, 114*c* such that each card extends at least partially out of the tray 106*a*, 106*b*, 106*c* to allow for easy removal of the card from their respective tray as needed. The cards are preferably configured as standard sized cards formed of a relatively stiff material with a rectangular configuration. However, the cards may take on different shapes and sizes and may be formed of different materials.

According to an aspect, a set of cards having a predetermined number is provided. The number of cards in the set depends upon the game of chance being played. The number of trays 106*a*, 106*b*, 106*c* among all of the turntables 100*a*, 100*b*, 100*c* is equal to the number of cards in the set. Each card in the set bears an indicia related to a decision for a game of chance. One card is removably disposed in each of the trays. Alternatively, each turntable can contain a complete set of cards that each bear an indicia related to a decision for a game of chance such that each turntable has a complete set of cards.

According to another aspect, the shuffler machine 12 can includes side post 116 that is oriented generally parallel to the central shaft 102. The side post 116 may have a base section 118 that is connected to the base portion 104. According to one aspect, the side post 116 includes a plurality of detents 120*a*, 120*b*, 120*c* or flappers fixed thereon relative to the base section 118. Each flapper 120*a*, 120*b*, 120*c* is associated with a respective one of the turntables 100*a*, 100*b*, 100*c* and can be moved by a game operator into or out of interaction with the dividers 108*a*, 108*b*, 108*c* of its associated turntables 100*a*, 100*b*, 100*c*. The detents 120*a*, 120*b*, 120*c* are independently effective to apply a pulsating resistance to the free rotation of the associated turntable 100*a*, 100*b*, 100*c* to thereby progressively slow its rotation to a stopped condition relative to the base portion 104. An exemplary detent is disclosed in Applicant's co-pending application Ser. No. 13/691,290, which is hereby incorporated by reference as though set forth fully herein. The detent may take on a variety of other suitable configurations. According to another aspect, the detents may be automatically engaged under computer control. According to still a further aspect, the turntable could be randomly stopped under computer control without the need for any detents or flappers or any action by a game operator.

Figure 4:
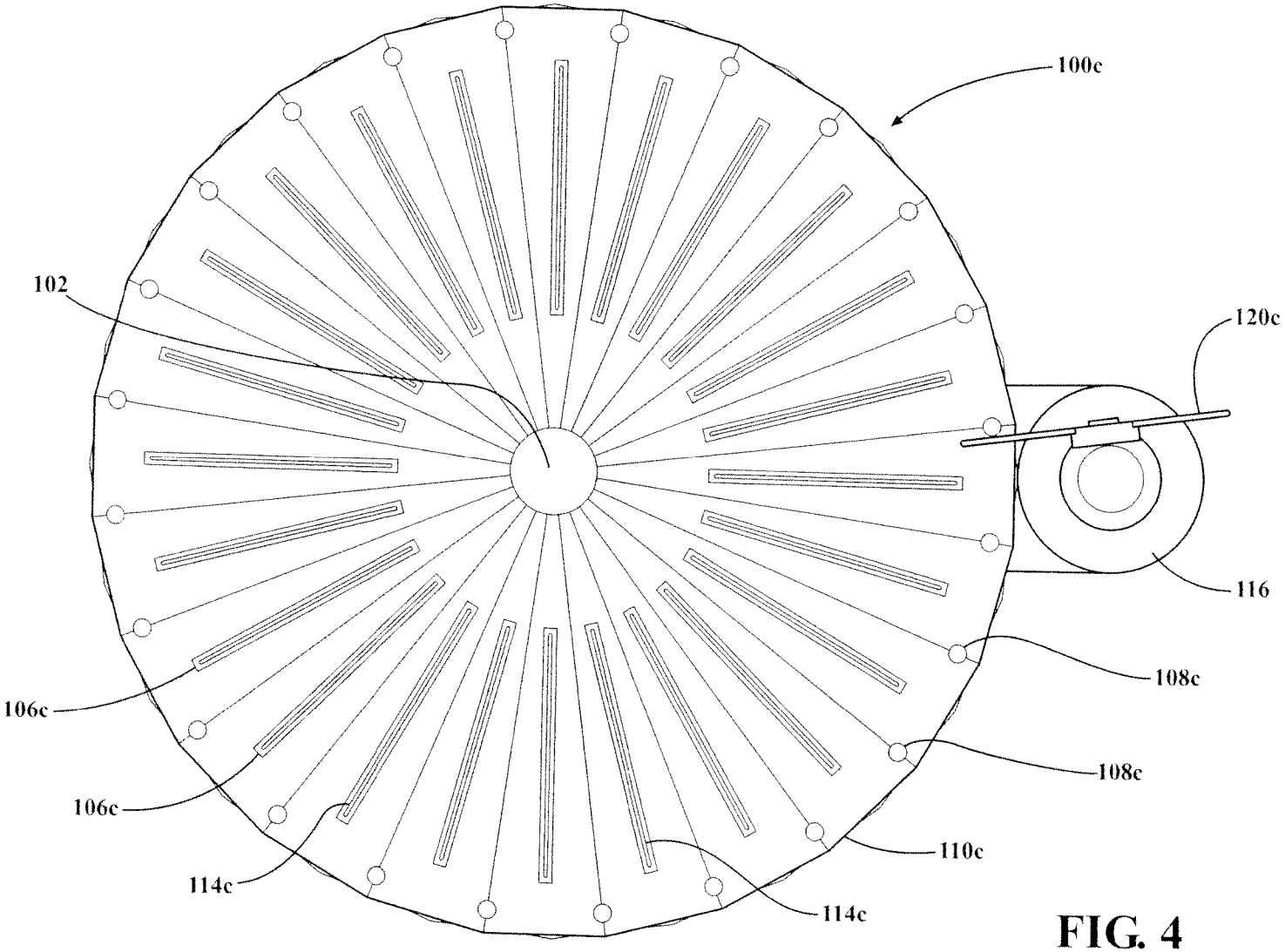
FIG. 4 is a top view of the shuffler machine of FIG. 2.
Figure 5:
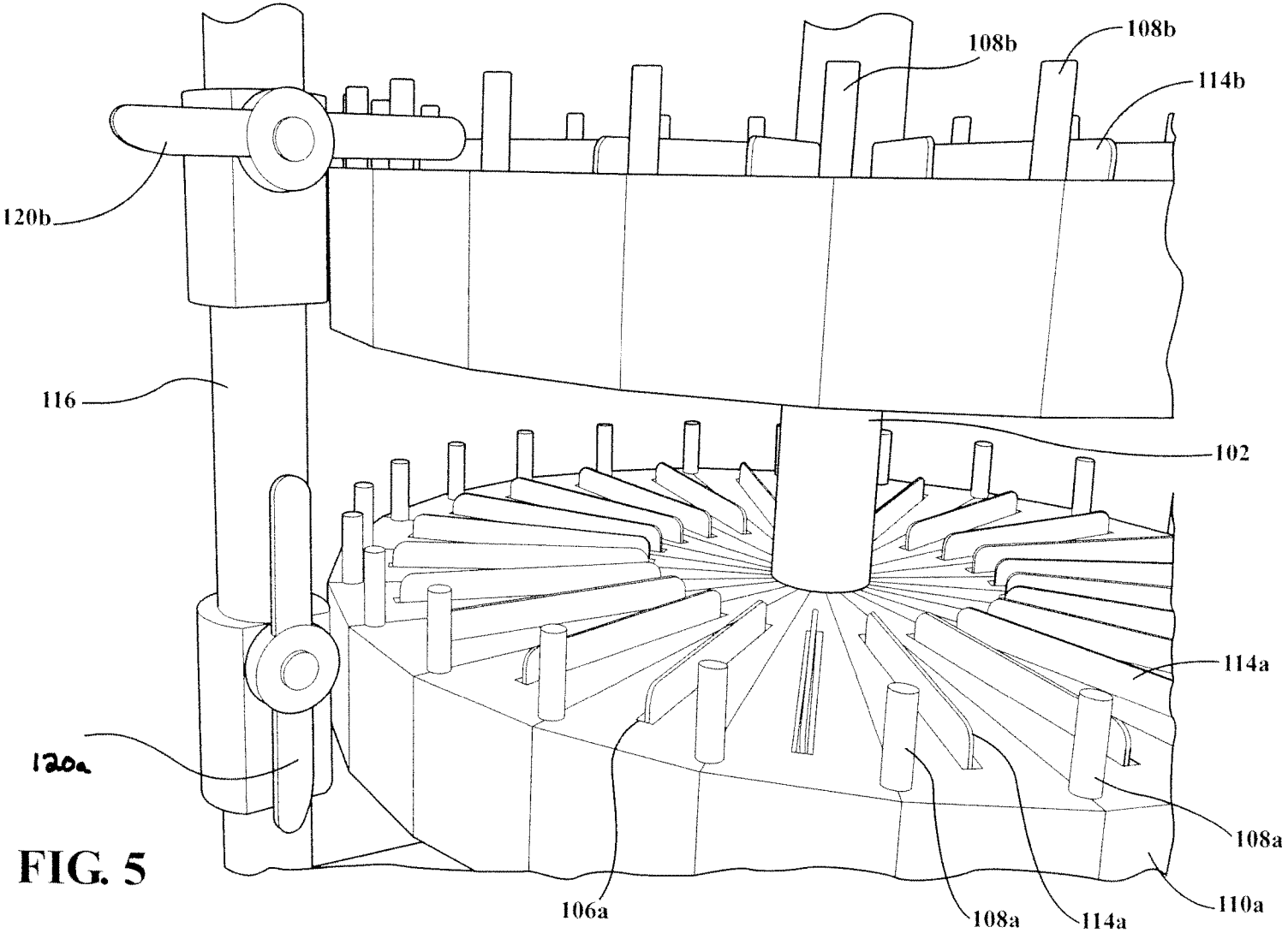
FIG. 5 is schematic illustration of a section of the shuffler machine of FIG. 2.

FIGS. 4 and 5 illustrate the configuration of the turntables 100*a*, 100*b*, 100*c* in more detail. The configuration of each of the turntables 100*a*, 100*b*, 100*c* is preferably the same. However, the configuration of the turntables can vary and a description of an exemplary turntable construction and operation may be had by reference to the Applicant's prior related innovations found in U.S. Pat. No. 7,669,853, entitled "Card Shuffling Machine", which issued on Mar. 2, 2010 which is hereby incorporated by reference as though set forth fully herein.

According to an aspect, the turntables 100*a*, 100*b*, 100*c* are independently supported for rotation on the central shaft 102 so that the game operator (not shown) can spin any turntable in either (CW or CCW) direction. Depending on the game being played, the operator may engage any one or more of the flappers 120*a*, 120*b*, 120*c* to progressively slow and identify or select a card from any one or more of the turntables 100*a*, 100*b*, 100*c* and thereby randomly generate a card or cards used in play of the game. By this machine, a random one or more of the cards may be selected from the set of cards by progressively slowing the freely rotating turntables 100*a*, 100*b*, 100*c* to rest through the interference of the detent. The machine may operate in other ways, including as discussed above.

Figure 6:
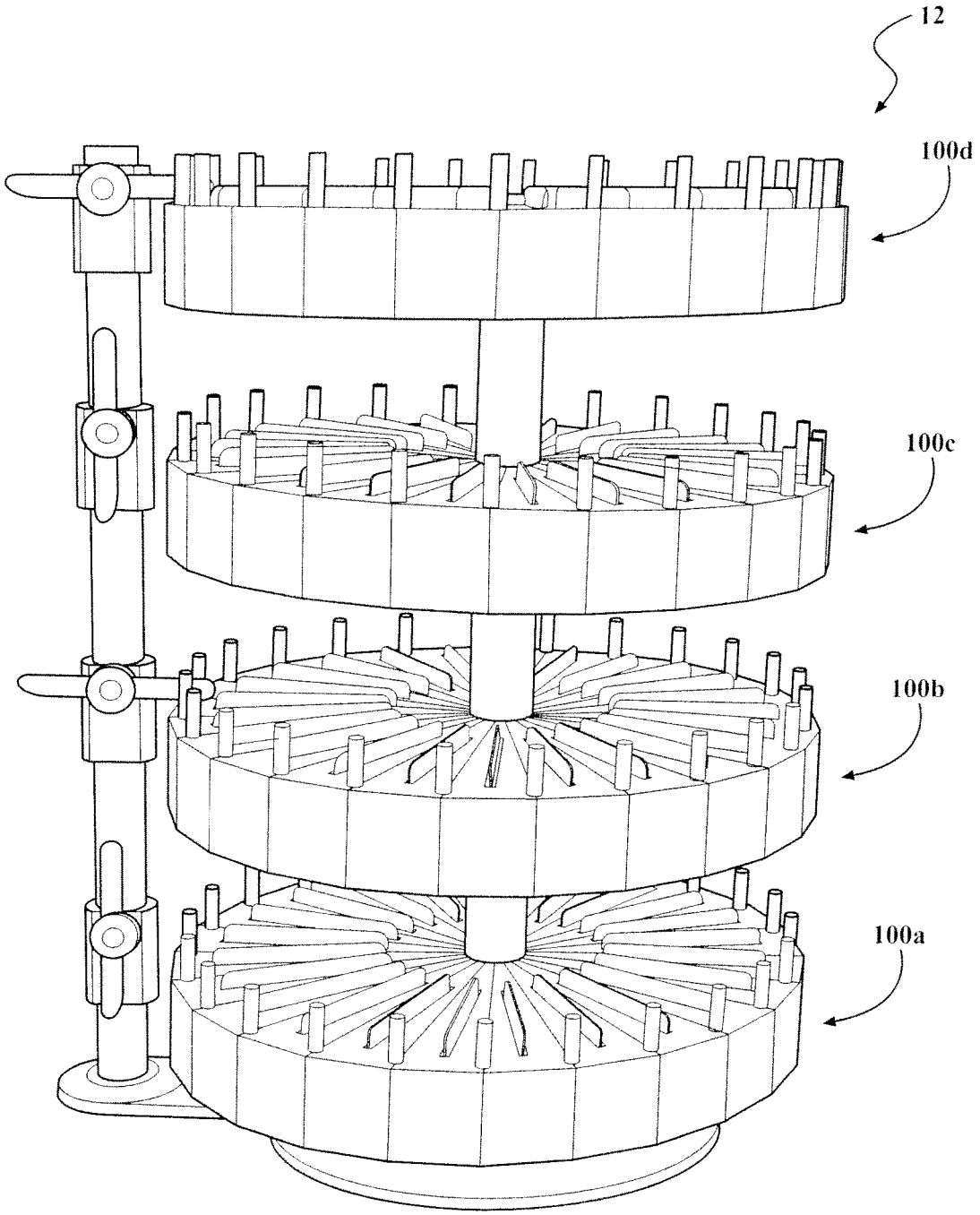
FIG. 6 is a perspective view of a shuffler machine according to another aspect of the disclosure.
Figure 7:
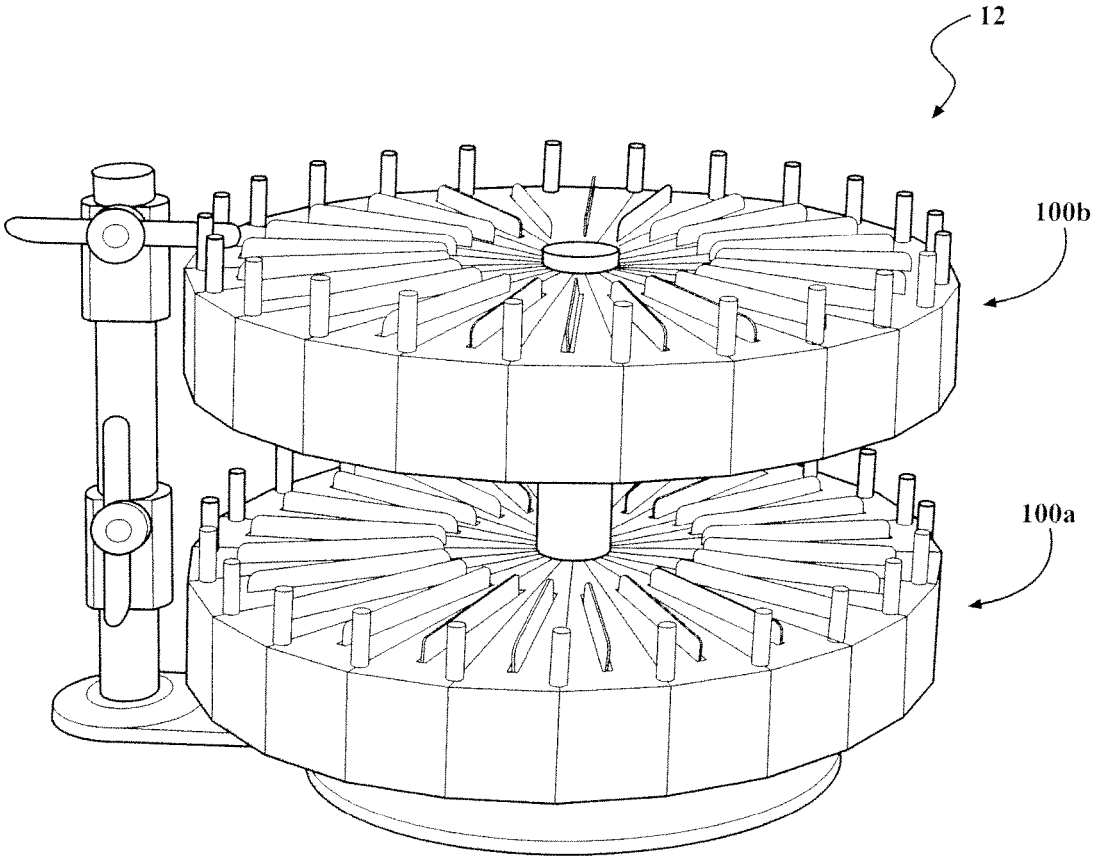
FIG. 7 is a perspective view of a shuffler machine according to still a further aspect of the disclosure.

As illustrated in FIGS. 6 and 7, the number of turntables can be less than or more than the three tiers shown in FIGS. 1-5. Of course, more than four tiers is also possible. Likewise, the number of trays 106*a*, 106*b*, 106*c* in each turntable 100*a*, 100*b*, 100*c* can be any suitable number. The drawing Figures all show 24 trays per turntable. This is an exemplary number only. Depending on the game played, the number of trays could be more or less than 24. Also, the number of trays may be different from one tier to the next in certain games.

Any suitable game of chance may be played with the present machine, including but not limited to roulette, craps, and the like. Another example of a game of chance that may be adapted for play with this invention includes that disclosed in U.S. Pat. No. 8,029,356 to Klein, issued Oct. 4, 2011.

The particular game(s) played using the subject machine will dictate the manner in which card decks are loaded into the turntables and the manner in which card(s) are withdrawn from the turntables to obtain game decisions. For example, in some games it may be desirable for the operator to set into spinning motion all of the turntables, but engage only certain flappers, and from those turntables to select a single card for the game play. In other cases, it may be desired that multiple cards be draw from each turntable 100*a*, 100*b*, 100*c* or perhaps different numbers of cards be drawn from different tiers. For example, in a craps style game with cards bearing indicia numbers 1-6, it may be desirable to pull two cards from each turntable to simulate a roll of two dice. In a further example, in a 3-tier system, the operator may set into spinning motion all 3 turntables, engage the flappers for all three turntables 100*a*, 100*b*, 100*c*, and withdraw two cards from the top tier 100*c*, one card from the middle tier 100*b* and four cards from the bottom tier 100*a*. It will be appreciated that any combination is possible. Thus, the selection of cards from the subject machine is not limited based on the composition of the deck.

In another example of game play uniquely enabled by the subject disclosure, a deck of 12 cards (or multiples thereof) are loaded into each turntable. The cards may be coded with particular identifying indicia, such as for example the colors red and blue. In this example, six cards are coded red and the other six cards coded blue. After setting the turntables in motion and then allowing one or more flappers in one or more of the tiers slow the turntables to a stop, the operator may (guided by game rules) begin withdrawing cards until two red and two blue cards have been selected. These four cards are used as the draw. In other words, the first two red cards and the first two blue cards are utilized as the game draw.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A method of playing multiple games of chance simultaneously, comprising:

providing a random number generator that simultaneously generates a plurality of random numbers, the random number generator having a base, a frame portion, a plurality of freely rotating structures supported by the frame potion wherein each of the plurality of freely rotating structures includes a turntable with a plurality of slots and a plurality of dividers disposed about an outer periphery of the turntable, the plurality of rotating structures disposed in the frame portion such that they all freely rotate about a single axis of rotation, and a plurality of detent mechanisms secured to the frame portion and each in communication with a respective one of the freely rotating structures to slow rotation of each freely rotating structure;

providing a plurality of separate groups of cards with each of the cards having indicia thereon which is relevant to an outcome of a game of chance, each group of cards having in total a number equal to the number of slots on a respective one of the plurality of freely rotating structures and each group of cards relating to a different game of chance;

placing the groups of cards in the slots in each of the plurality of freely rotating structures with each group of cards on a different freely rotating structure;

freely rotating each of the plurality of freely rotating structures simultaneously sufficiently to generate a random number on each freely rotating structure;

selectively engaging the plurality of dividers on each of the plurality of freely rotating structures using the plurality of detent mechanisms to stop their free rotation; and identifying at least one card from each of the plurality of freely rotating structures that is relevant to the outcome of the game of chance that is associated with each group of cards.

2. The method of claim 1, wherein the random number generator includes two freely rotating structures.

3. The method of claim 1, wherein the random number generator includes three freely rotating structures.

4. The method of claim 1, wherein each of the cards of one of the groups bear indicia relevant to the game of roulette.

5. The method of claim 1, wherein each of the cards of one of the groups bear indicia relevant to the game of craps.

6. A table game of chance having a random number generator whereby the random number generator simultaneously generates a plurality of random numbers, the random number generator comprising:

a base portion to be located adjacent a betting surface having a plurality of player positions and a plurality of wagering areas that allow players located at each of the plurality of player positions to place wagers on an outcome of the game of chance;

a frame in communication with the base portion and extending generally upward therefrom;

a first freely rotating structure disposed on the frame and in rotational communication therewith about a first axis of rotation, the first rotating structure including a first turntable having a first plurality of slots and a first plurality of dividers disposed about an outer periphery of the first rotating structure, the first plurality of slots adapted for receiving cards bearing indicia relevant to an outcome of a first game of chance;

a first detent mechanism secured to the frame and in communication with the first plurality of dividers of the first rotating structure to slow rotation of the first rotating structure such that a first selected card can be identified from the first rotating structure, the first selected card determining a first outcome of a first game of chance for a single round of play;

a second freely rotating structure disposed on the frame and in rotatable communication therewith about a second axis of rotation, the second rotating structure including a second turntable having a second plurality of slots and a second plurality of dividers disposed about an outer periphery of the second rotating structure, each of the second plurality of slots disposed about an outer periphery of the second rotating structure, each of the second plurality of slots adapted for receiving cards bearing indicia relevant to an outcome of a second game of chance;

a second detent mechanism secured to the frame and in communication with the second plurality of dividers of the second rotating structure to slow rotation of the second rotating structure such that a second selected card can be identified from the second rotating structure, the second selected card determining a first outcome of the second game of chance for the single round of play;

whereby the first rotating structure and the second rotating structure can freely rotate about their axis of rotation independently of each other to simultaneously generate a first and a second random number.

7. The random number generator of claim 6, wherein each of the plurality of rotating structures is a generally circular disc.

8. The random number generator of claim 7, further comprising:

three rotating structures, wherein the third rotating structure is freely rotating and disposed on the frame and in rotatable communication therewith about an axis of rotation, the third rotating structure including a third turntable having a third plurality of slots and a third plurality of dividers disposed about an outer periphery of the third rotating structure, each of the third plurality of slots disposed about an outer periphery of the third rotating structure, each of the third plurality of slots adapted for receiving cards bearing indicia relevant to an outcome of a game of chance;

a third detent mechanism secured to the frame and in communication with the third plurality of dividers of the third rotating structure to slow rotation of the third rotating structure such that a third selected card can be identified from the third rotating structure, the third selected card determining an outcome of one of the first or second game of chance or an outcome of a third game of chance for the single round of play; and whereby the first, second and third rotating structures can freely rotate about their axis of rotation independently of each other to simultaneously to generate a first, second and a third random number.

9. The random number generator claim 7, wherein the plurality of rotating structures are disposed one on top of the other vertically.

10. The random number generator of claim 7, wherein some of the cards bear indicia relevant to the game of roulette.

11. The random number generator of claim 7, wherein some of the cards bear indicia relevant to the game of craps.

12. The random number generator of claim 8, further comprising:

four rotating structures, wherein the fourth rotating structure is freely rotating and disposed on the frame and in rotatable communication therewith about an axis of rotation, the fourth rotating structure including a fourth turntable having a fourth plurality of slots and a fourth plurality of dividers disposed about an outer periphery of the fourth rotating structure, each of the fourth plurality of slots disposed about an outer periphery of the fourth rotating structure, each of the fourth plurality of slots adapted for receiving cards bearing indicia relevant to an outcome of a game of chance;

a fourth detent mechanism secured to the frame and in communication with the fourth plurality of dividers of the fourth rotating structure to slow rotation of the fourth rotating structure such that a fourth selected card can be identified from the fourth rotating structure, the fourth selected card determining an outcome for one of the first, second or third game of chance or an outcome of a fourth game of chance for the single round of play; and whereby the first, second, third and fourth rotating structures can freely rotate about their axis of rotation independently of each other to simultaneously to generate a first, second, third and fourth random number.

13. The random number generator of claim 9, further comprising:

a center shaft that runs through a center of each of the plurality of rotating structures around which they can rotate.

* * * * *